US007721750B2

(12) United States Patent
Lindner

(10) Patent No.: US 7,721,750 B2
(45) Date of Patent: May 25, 2010

(54) MODIFIED HEAT PIPE FOR ACTIVATION OF A PRESSURE RELIEF DEVICE

(75) Inventor: Markus Lindner, Mainz (DE)

(73) Assignee: GM Global Technology Operations, Inc., Detroit, MI (US)

( * ) Notice: Subject to any disclaimer, the term of this patent is extended or adjusted under 35 U.S.C. 154(b) by 448 days.

(21) Appl. No.: 11/874,270

(22) Filed: Oct. 18, 2007

(65) Prior Publication Data

US 2009/0101314 A1 Apr. 23, 2009

(51) Int. Cl.
*F16K 17/38* (2006.01)
*F16K 17/40* (2006.01)

(52) U.S. Cl. ..... 137/72; 137/79; 165/104.26

(58) Field of Classification Search ..... 137/72, 137/76; 165/104.19, 104.21, 104.26
See application file for complete search history.

(56) References Cited

U.S. PATENT DOCUMENTS 3,576,210 A * 4/1971 Trent ..... 165/104.26
4,003,427 A * 1/1977 Leinoff et al. ..... 165/104.26
4,116,266 A * 9/1978 Sawata et al. ..... 165/104.26
4,170,262 A * 10/1979 Marcus et al. ..... 165/104.26
5,042,520 A * 8/1991 Reznik ..... 137/79
5,076,352 A * 12/1991 Rosenfeld et al. ..... 165/104.26
5,201,336 A * 4/1993 Taylor et al. ..... 137/72
5,551,470 A 9/1996 Duvall
5,848,604 A 12/1998 Eihusen
6,006,774 A 12/1999 Lhymn et al.
6,382,232 B1 5/2002 Portmann

* cited by examiner

*Primary Examiner*—John Rivell
(74) *Attorney, Agent, or Firm*—Fraser Clemens Martin & Miller LLC; J. Douglas Miller

(57) ABSTRACT

A heat pipe is disclosed, the heat pipe capable of transferring heat to actuate a pressure relief device by heat transfer through either capillary action involving a wicking material and a working fluid, or by a consumable fuse in the case of leakage of the working fluid from the heat pipe.

20 Claims, 2 Drawing Sheets

MODIFIED HEAT PIPE FOR ACTIVATION OF A PRESSURE RELIEF DEVICE

FIELD OF THE INVENTION

The invention relates to a thermally responsive device for activating a pressure relief device. More particularly, the invention is directed to a heat pipe capable of activating a pressure relief device by heat transfer through one of a capillary action and a fuse.

BACKGROUND SUMMARY

Presently there are a variety of pressure vessels developed for use in various applications, such as those designed to contain gases for use in fuel cells. Fuel cells have been proposed as a clean, efficient and environmentally responsible power source for electric vehicles and various other applications. One example of a fuel cell is a Proton Exchange Membrane (PEM) fuel cell. In PEM type fuel cells, hydrogen is supplied as a fuel to an anode of the fuel cell and oxygen is supplied as an oxidant to a cathode. Hydrogen is colorless, odorless, burns without producing a visible flame or radiant heat, and is difficult to contain. A common technique for storing hydrogen is in a lightweight, high pressure vessel resistant to punctures.

Traditionally such vessels are divided into four types. A Type I vessel is a metal vessel. A Type II vessel is also a metal vessel, the vessel having an outer composite shell disposed on a cylindrical section thereof. A Type III vessel consists of a liner produced from a metal such as steel and aluminum, for example, and an outer composite shell that encompasses the liner and militates against damage thereto. A Type IV vessel is substantially similar to the Type III vessel, wherein the liner is produced from a plastic. Furthermore, a conceptual Type V vessel may be developed, wherein the vessel is produced from a composite material. Each type of vessel may include a metal boss disposed therein to house a pressure relief device (PRD).

The PRD is in fluid communication with the interior of the vessel and, when actuated, vents the hydrogen in the vessel to decrease the internal pressure therein. A variety of PRD's are known, and can be actuated thermally, by pressure, or by a combination of both. In a fuel cell system, the internal pressure of the vessel rarely builds to beyond containable levels before the structural integrity of the lightweight vessel is compromised. Therefore, a fuel cell has traditionally been fitted with a thermal PRD such as the one disclosed in U.S. Pat. No. 6,006,774, hereby incorporated herein by reference in its entirety.

Typically, when the ambient air reaches a predetermined temperature, the PRD is actuated. However, where vessels are long, remote portions of the vessel insulated from the PRD can be exposed to localized heat sources without causing actuation of the PRD. Exposure to these localized heat sources can result in a rupture of the vessel. Therefore, to actuate the PRD regardless of exposure to the localized heat source, various pipes, conduits, venting lines, and fuses which actuate the PRD have been positioned along the vessel.

One such pipe is disclosed in U.S. Pat. No. 5,848,604. An elongate pressure vessel is disclosed having a single PRD located at one end. The PRD is thermally coupled to a heat pipe. The heat pipe, which extends generally parallel to an axis of the pressure vessel, conducts heat from the localized heat source at the remote location directly to the PRD. The outer casing of the pipe is made from a thermally conductive metal and is lined with a wicking material, which is capable of moving a fluid by capillary action. The inside of the pipe is filled with a vaporizable fluid. When heat is applied to the pipe, the fluid, which has permeated the wicking material, vaporizes and moves through the central core of the pipe, repeatedly condensing and vaporizing as it travels toward the PRD, until it transfers the heat to the PRD and causes the PRD to actuate.

A fuse is disclosed in U.S. Pat. No. 6,382,232. A heat responsive fuse cord is disclosed which is thermally coupled to a PRD. The PRD is in fluid communication with the pressurized contents of a vessel. When ignited, the fuse cord burns to a thermal coupler, transferring the heat to the thermal actuator of the PRD.

Alternatively, multiple PRDs may be positioned at a plurality of locations along a vessel. Each PRD communicates with the interior of the vessel via a common high pressure line extending from the boss.

Since such devices could be damaged or broken during an accident, and multiple PRDs are expensive, it would be desirable to produce a heat pipe wherein the cost thereof is minimized and the reliability thereof is maximized.

SUMMARY OF THE INVENTION

According to the present invention, a heat pipe wherein the cost thereof is minimized and the reliability thereof is maximized, has surprisingly been discovered.

In one embodiment, the heat pipe comprises a sealed casing having spaced apart ends; a porous wicking material disposed in the casing; a working fluid disposed in the casing permeating the wicking material, the working fluid adapted to transfer heat within the casing; and a fuse disposed in the casing for transporting heat within the casing upon damage to the casing causing leakage of the working fluid.

In another embodiment, the thermally responsive system comprises a pressure relief device; and a heat pipe thermally coupled to the pressure relief device, the heat pipe further comprising: a thermally conductive sealed casing having spaced apart ends; a porous wicking material disposed in the casing capable of moving a fluid by capillary action; a vaporizable working fluid disposed in the casing permeating the wicking material, the working fluid adapted to transfer heat within the casing; and a fuse disposed in the casing for transporting heat within the casing upon damage to the casing causing leakage of the working fluid, the fuse capable of being activated by at least one of oxygen and a localized heat source.

In another embodiment, the thermally responsive system for a fuel cell comprises a vessel for containing a pressurized fluid, the vessel having a first end and a second end; a pressure relief device disposed in the first end of the vessel for venting the vessel at a predetermined temperature; and a heat pipe thermally coupled to the pressure relief device extending generally parallel to the longitudinal axis of the vessel to a portion of the vessel spaced from the pressure relief device, the heat pipe adapted to transmit heat from the portion of the vessel to the pressure relief device, the heat pipe further comprising: a thermally conductive sealed casing having spaced apart ends; a porous wicking material disposed in the casing capable of moving a fluid by capillary action; a vaporizable working fluid disposed in the casing permeating the wicking material, the working fluid adapted to transfer heat within the casing; and a fuse disposed in the casing for transporting heat within the casing upon damage to the casing causing leakage of the working fluid, the fuse capable of being activated by at least one of oxygen and a localized heat source.

DESCRIPTION OF THE DRAWINGS

The above features of the invention will become readily apparent to those skilled in the art from reading the following detailed description of the invention when considered in the light of the accompanying drawings, in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
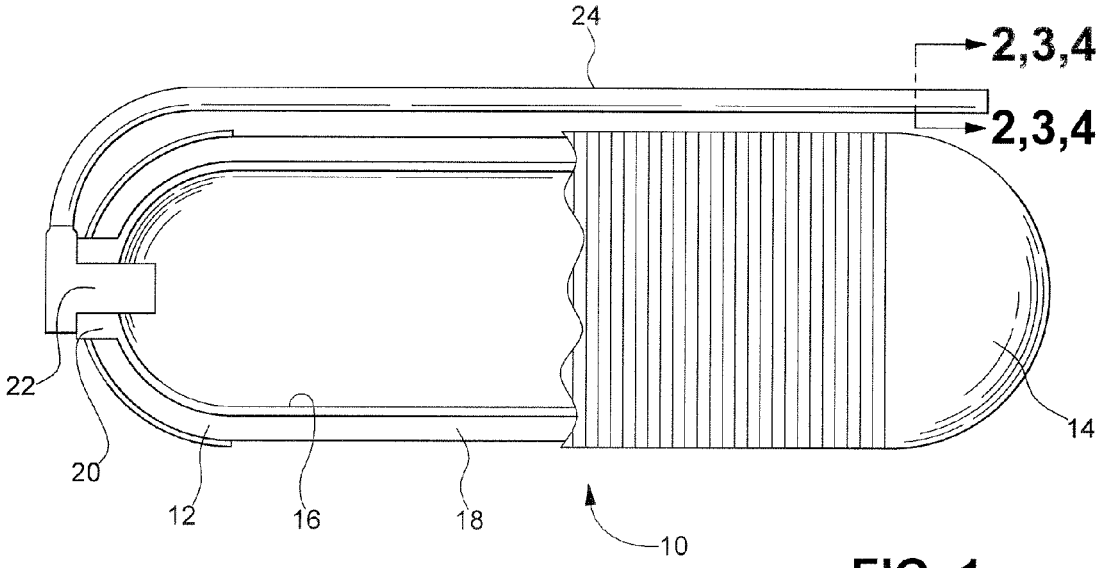
FIG. 1 is a side elevational view partially in section of a heat pipe thermally coupled to a pressure relief device disposed in a pressure vessel according to an embodiment of the invention.

FIG. 1 shows a thermally responsive pressure relief system for a Type IV pressure vessel 10 according to an embodiment of the invention. It is understood that the thermally responsive pressure relief system can be used with other vessel types such as a Type I, a Type II, a Type III, and a Type V, for example. The pressure vessel 10 includes a first end 12 and a second end 14. A wall forming the vessel 10 includes a liner 16 to contain a pressurized fluid and an outer composite shell 18 that encompasses the liner 16 and militates against damage thereto. In the embodiment shown, the liner 16 is produced from a plastic material, although other materials can be used as desired.

The first end 12 of the vessel 10 is provided with a boss 20 for receiving a pressure relief device (PRD) 22. A single PRD 22 is disposed in the boss 20 such that the PRD 22 communicates with an interior of the vessel 10 to vent the vessel 10 when subjected to temperatures above a predetermined temperature. In the embodiment shown, the PRD 22 is a thermally responsive PRD. A heat pipe 24, thermally coupled to the PRD 22, extends from the PRD 22 and along an exterior of the vessel 10 in a direction generally parallel to a longitudinal axis of the vessel 10. The heat pipe 24 extends to a desired location along the vessel 10. It is understood that the heat pipe 24 can extend to the second end 14, if desired.

Figure 2:
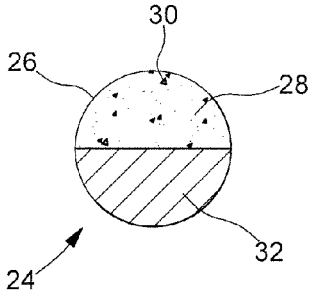
FIG. 2 is a cross-sectional view of the heat pipe illustrated in FIG. 1, wherein the wicking material and the working fluid are disposed in the upper hemispherical section of the heat pipe and the fuse is disposed in the lower hemispherical section of the heat pipe.
Figure 3:
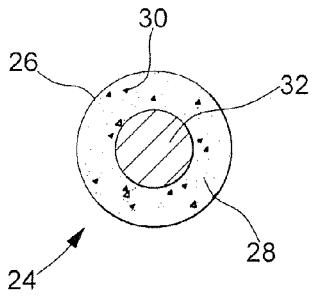
FIG. 3 is a cross-sectional view of the heat pipe illustrated in FIG. 1, according to another embodiment of the invention.
Figure 4:
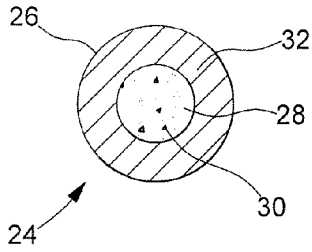
FIG. 4 is a cross-sectional view of the heat pipe illustrated in FIG. 1, according to another embodiment of the invention.

As illustrated in FIGS. 2, 3, and 4, the heat pipe 24 includes an outer casing 26. A wicking material 28, capable of moving a fluid by capillary action, is disposed in the casing 26. A working fluid 30 is disposed in the casing and permeates the wicking material 28. A fuse 32 is also provided in the casing. In the embodiment shown, the fuse 32 is adapted to transfer heat generated by an exothermic reaction caused by an exposure of the fuse to at least one of oxygen and a localized heat source. An accumulation of the fuse 32 may be disposed adjacent the end 38 of the heat pipe 24 thermally coupled to the PRD 22 to increase the heat generated adjacent the PRD 22 to ensure enough heat for activation of the PRD 22. The casing 26 is sealed to isolate the working fluid 30 from the outside environment and may be produced from any thermally conductive material such as copper, nickel, stainless steel, and the like, for example. The wicking material 28 is produced from a porous material such as a metal foam, a ceramic, and a carbon fiber, and the like, for example. The working fluid 30 can be any vaporizable fluid such as water, methanol, and the like, for example. In the embodiment shown, the heat pipe 24 has a generally circular cross-sectional shape. However, it is understood that the heat pipe 24 may have other cross-sectional shapes as desired.

FIG. 2 shows the wicking material 28 and the working fluid 30 disposed in the upper hemispherical section of the heat pipe 24 and the fuse 32 disposed in the adjacent lower hemispherical section of the heat pipe 24. It is understood that the wicking material 28 and the working fluid 30 can be disposed in the outer section of the heat pipe 24 encapsulating the fuse 32 as shown in FIG. 3, the inner section of the heat pipe 24 having the fuse 32 encapsulate the wicking material 28 and the working fluid 30 as shown in FIG. 4, or elsewhere in the heat pipe 24 as desired.

Figure 5:
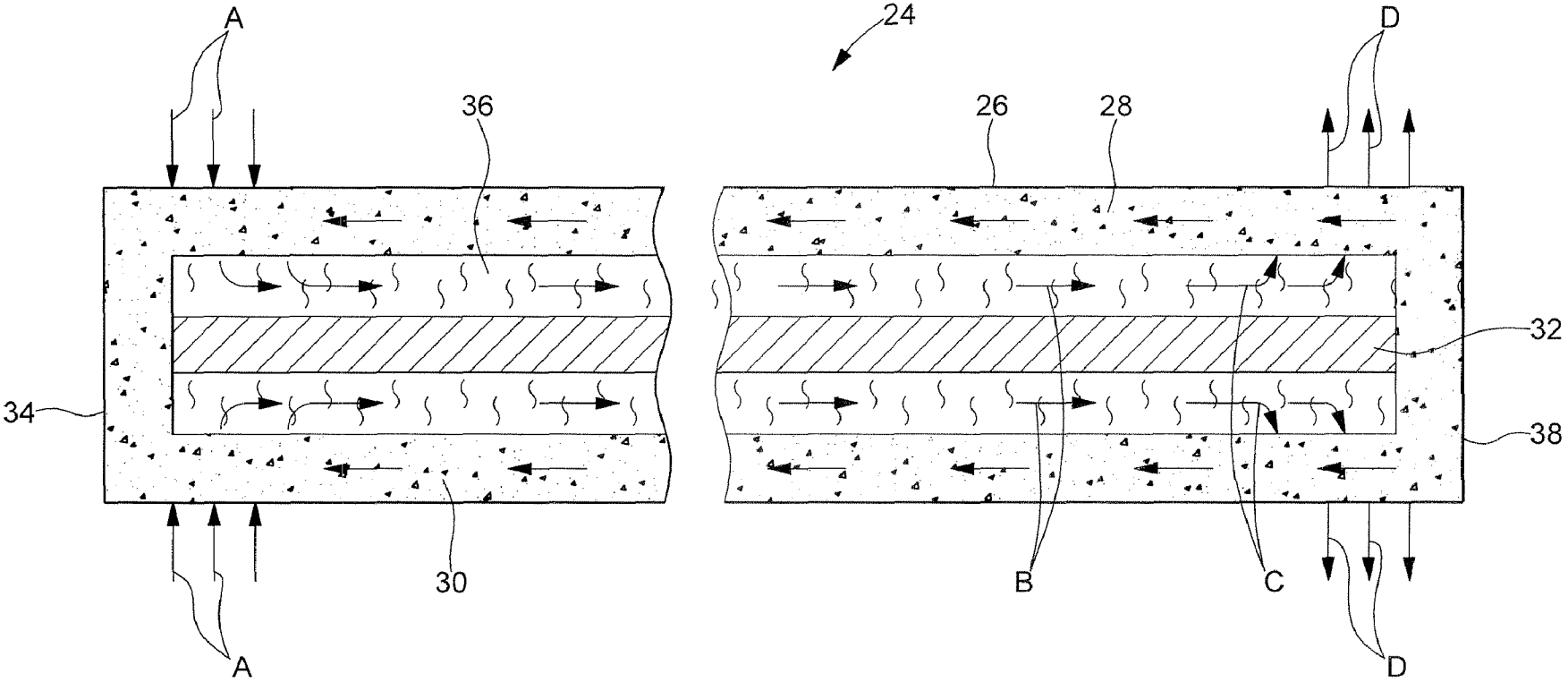
FIG. 5 is a schematic diagram showing heat transfer by capillary action through the heat pipe illustrated in FIG. 3.

FIG. 5 illustrates the heat pipe 24 in use. When the heat pipe 24 is subjected to temperatures above the predetermined temperature at a location 34 along the vessel 10 as indicated by arrows "A", the working fluid 30 is caused to vaporize into a gas 36. The gas 36 is then caused to flow to a cooler location in the heat pipe 24 as indicated by arrows "B". Thus, heat is transferred through an interior of the heat pipe 24 and conducted by the casing 26 from the location subjected to temperatures above the predetermined temperature to the cooler location in heat pipe 24. The gas 36 then condenses at the cooler location as indicated by arrows "C". The condensing of the gas 36 emits heat, indicated by arrows "D", at an end 38 of the heat pipe 24 thermally coupled to the PRD 22. The vaporization and condensation cycle continues until the heat emitted actuates the PRD 22. Upon actuation of the PRD 22, the pressurized contents of the vessel 10 are vented.

However, if the heat pipe 24 is damaged, the working fluid 30 may leak from the heat pipe 24. Accordingly, the heat pipe 24 becomes inoperable. When the heat pipe 24 is damaged, the fuse 32 disposed in the heat pipe 24 can actuate the PRD 22. The fuse 32 may be activated by at least one of oxygen and a localized heat source. The heat generated is transferred by a progressive consumption of the fuse 32 through the interior of the heat pipe 24 to the end 38 of the heat pipe 24 thermally coupled to the PRD 22. When the heat generated reaches a predetermined temperature, the PRD 22 is caused to actuate, thereby venting the pressured contents of the vessel 10.

It is understood that the effectiveness of the heat pipe 24 is not limited to temperatures above the predetermined temperature being applied to the remote location 34 of the vessel 10. The heat pipe 24 operates to transfer heat from any location along the vessel 10 to the cooler location along the heat pipe 24. The PRD 22 and boss 20 are provided with substantial mass which will typically be the cooler location along the heat pipe 24 to which the heat will migrate.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A heat pipe comprising: a sealed casing having spaced apart ends; a porous wicking material disposed in the casing; a working fluid disposed in the casing permeating the wicking material, the working fluid adapted to transfer heat within the casing; and a consumable fuse disposed in the casing for transporting heat within the casing.

2. The heat pipe according to claim 1, wherein the casing is produced from a thermally conductive material.

3. The heat pipe according to claim 1, wherein one end of the casing is thermally coupled to a pressure relief device.

4. The heat pipe according to claim 3, wherein the pressure relief device vents a pressure vessel at a predetermined temperature.

5. The heat pipe according to claim 4, wherein the casing extends generally parallel to the longitudinal axis of the vessel and one end of the casing is disposed adjacent a portion of the vessel spaced from the pressure relief device for transmitting heat from the portion of the vessel to the pressure relief device.

6. The heat pipe according to claim 1, wherein the wicking material is capable of moving a fluid by capillary action and the working fluid is vaporizable.

7. The heat pipe according to claim 1, wherein the consumable fuse is capable of being activated by at least one of oxygen and a localized heat source.

8. The heat pipe according to claim 1, wherein the wicking material and the working fluid are disposed in the casing adjacent the consumable fuse.

9. The heat pipe according to claim 1, wherein the consumable fuse is disposed in the casing encapsulating the wicking material and the working fluid.

10. The heat pipe according to claim 1, wherein the wicking material and the working fluid are disposed in the casing encapsulating the consumable fuse.

11. A thermally responsive system comprising: a pressure relief device; and a heat pipe thermally coupled to the pressure relief device, the heat pipe further comprising: a thermally conductive sealed casing having spaced apart ends; a porous wicking material disposed in the casing capable of moving a fluid by capillary action; a vaporizable working fluid disposed in the casing permeating the wicking material, the working fluid adapted to transfer heat within the casing; and a consumable fuse disposed in the casing for transporting heat within the casing, the consumable fuse capable of being activated by at least one of oxygen and a localized heat source.

12. The thermally responsive system according to claim 11, wherein the pressure relief device vents a pressure vessel at a predetermined temperature.

13. The thermally responsive system according to claim 12, wherein the casing extends generally parallel to the longitudinal axis of the vessel and one end of the casing is disposed adjacent a portion of the vessel spaced from the pressure relief device for transmitting heat from the portion of the vessel to the pressure relief device.

14. The thermally responsive system according to claim 11, wherein the wicking material and the working fluid are disposed in the casing adjacent the consumable fuse.

15. The thermally responsive system according to claim 11, wherein the consumable fuse is disposed in the casing encapsulating the wicking material and the working fluid.

16. The thermally responsive system according to claim 11, wherein the wicking material and the working fluid are disposed in the casing encapsulating the consumable fuse.

17. A thermally responsive system for a fuel cell comprising: a vessel for containing a pressurized fluid, the vessel having a first end and a second end; a pressure relief device disposed in the first end of the vessel for venting the vessel at a predetermined temperature; and a heat pipe thermally coupled to the pressure relief device extending generally parallel to the longitudinal axis of the vessel to a portion of the vessel spaced from the pressure relief device, the heat pipe adapted to transmit heat from the portion of the vessel to the pressure relief device, the heat pipe further comprising: a thermally conductive sealed casing having spaced apart ends; a porous wicking material disposed in the casing capable of moving a fluid by capillary action; a vaporizable working fluid disposed in the casing permeating the wicking material, the working fluid adapted to transfer heat within the casing; and a consumable fuse disposed in the casing for transporting heat within the casing, the consumable fuse capable of being activated by at least one of oxygen and a localized heat source.

18. The thermally responsive system for a fuel cell according to claim 17, wherein the wicking material and the working fluid are disposed in the casing adjacent the consumable fuse.

19. The thermally responsive system for a fuel cell according to claim 17, wherein the consumable fuse is disposed in the casing encapsulating the wicking material and the working fluid.

20. The thermally responsive system for a fuel cell according to claim 17, wherein the wicking material and the working fluid are disposed in the casing encapsulating the consumable fuse.

* * * * *